US006154908A

United States Patent [19]

Wells

[11] Patent Number: 6,154,908

[45] Date of Patent: Dec. 5, 2000

[54] BEDDING OR SEATING PRODUCT WITH EDGE SUPPORT

[75] Inventor: Thomas J. Wells, Carthage, Mo.

[73] Assignee: L&P Property Management Company, South Gate, Calif.

[21] Appl. No.: 09/153,837

[22] Filed: Sep. 15, 1998

[51] Int. Cl.[7] ..... A47C 27/04

[52] U.S. Cl. ..... 5/720; 5/739

[58] Field of Search ..... 5/717, 720, 727, 5/739; 269/93, 96, 97, 102

[56] References Cited

U.S. PATENT DOCUMENTS

| | | | |
|---|---|---|---|
| 958,116 | 5/1910 | Hampton . | |
| 1,246,081 | 11/1917 | Genge . | |
| 1,682,394 | 8/1928 | Meutsch | 5/720 |
| 1,741,847 | 12/1929 | Kaspar . | |
| 1,947,931 | 2/1934 | Falls . | |
| 1,986,255 | 1/1935 | Durfey et al. . | |
| 1,997,237 | 4/1935 | Schrier . | |
| 2,025,329 | 12/1935 | Bronstien . | |
| 2,184,572 | 12/1939 | Wainess . | |
| 2,244,543 | 6/1941 | Seavert . | |
| 2,651,059 | 9/1953 | Platt . | |
| 2,826,769 | 3/1958 | Drews . | |
| 3,022,521 | 2/1962 | Martin . | |
| 3,089,154 | 5/1963 | Boyles . | |
| 3,121,882 | 2/1964 | Drews . | |
| 3,121,883 | 2/1964 | Kline . | |
| 3,324,485 | 6/1967 | Haney et al. . | |
| 3,618,146 | 11/1971 | Ferdinand . | |
| 3,822,426 | 7/1974 | Mistarz . | |
| 3,872,525 | 3/1975 | Lea et al. . | |
| 3,982,290 | 9/1976 | Ward . | |
| 4,389,743 | 6/1983 | Callaway | 5/739 X |
| 4,462,129 | 7/1984 | Brannock | 5/720 X |
| 4,867,423 | 9/1989 | Marsh . | |
| 5,062,172 | 11/1991 | Stewart . | |
| 5,105,488 | 4/1992 | Hutchinson et al. . | |
| 5,113,539 | 5/1992 | Strell . | |
| 5,133,116 | 7/1992 | Wagner et al. . | |
| 5,239,715 | 8/1993 | Wagner . | |
| 5,304,271 | 4/1994 | Gusakov . | |
| 5,537,699 | 7/1996 | Bonaddio et al. | 5/739 |
| 5,557,813 | 9/1996 | Steed et al. . | |
| 5,636,396 | 6/1997 | Workman et al. . | |

FOREIGN PATENT DOCUMENTS

| | | |
|---|---|---|
| 230048 | 3/1963 | Austria . |
| 780450 | 4/1935 | France . |
| 281699 | 7/1952 | Switzerland . |
| 586765 | 3/1947 | United Kingdom . |

*Primary Examiner*—Michael F. Trettel
*Attorney, Agent, or Firm*—Wood, Herron & Evans, L.L.P.

[57] ABSTRACT

A bedding or seating product comprising a centrally located spring core, edge support means located around the perimeter of the spring core, filling material located above and below the spring core and an upholstered covering. The edge support may be either a string of springs, a pair of spiral edge supports or plastic edge reinforcements. The edge support means extends above and below the upper and lower surfaces of the spring core thus creating a higher peripheral edge than the central portion of the spring core. Layers of filling material are inserted over the central portion of the spring core in order to create a uniform upper and lower surface.

8 Claims, 3 Drawing Sheets

BEDDING OR SEATING PRODUCT WITH EDGE SUPPORT

FIELD OF THE INVENTION

This invention relates to bedding or seating products, and more particularly, to edge supports used to strengthen or rigidify the periphery of a bedding or seating product.

DESCRIPTION OF THE PRIOR ART

A traditional bedding or seating product has an inner spring core comprising a plurality of identically configured coil springs arranged in linear columns and rows. If such a spring core is used in a bedding product, the spring core is covered with a mattress pad or covering materials and an upholstered covering surrounds and encases the spring core and mattress pad. Such a traditional bedding or seating product typically has one degree of firmness throughout because all of the springs of the inner spring core are identical.

Bedding or seating products do exist which have increased firmness about the edge portions of the bedding or seating product, primarily to prevent collapse of the side edges of the bedding or seating product when a person sits on the side edges. These edge reinforcements also prevent loss of resiliency of the edge of the bedding or seating product as a result of persons repeated getting on and off the product or by sitting or leaning on one edge of the bedding or seating product.

One method of firming up the outer periphery or edge of a mattress is disclosed in U.S. Pat. No. 5,133,116. According to the disclosure of this patent a rope is wrapped for several revolutions around the perimeter of the mattress and between adjacent convolutions of the outermost peripheral coil springs of the mattress.

Another method is disclosed in applicants' own U.S. Pat. No. 5,636,396 wherein an inflatable pneumatic tube placed around the periphery of a bedding product increases the firmness of the periphery of the product. The pneumatic tube enables a user to adjust the firmness around the periphery of the bedding product by changing the pressure inside the tube.

Another method of reinforcing the edge of a mattress is disclosed in U.S. Pat. No. 3,089,154. According to the disclosure of this patent, conventional mattress padding 44 extends between adjacent convolutions of the outermost coil springs of the mattress.

According to U.S. Pat. No. 2,826,769 a piece of foam rubber extends around the mattress and is inserted into the interior portion of the outermost or peripheral coil springs to support or reinforce the edge or border of a mattress.

U.S. Pat. Nos. 3,618,146 and 3,822,426 both disclose resilient foam inserted between the convolutions of the outermost or peripheral coil springs in order to stabilize the border of an inner spring mattress. The resilient foam is held in place by the pitch or angle of the convolutions of the helical coils of the coil springs.

U.S. Pat. Nos. 5,062,172; 3,022,521 and 3,121,882 all disclose edge support springs of differing configurations to enhance the firmness of the periphery of a bedding product.

Each of these patents discloses different devices or methods for enhancing the firmness of the peripheral or edge portions of a bedding or seating product. However, each of these edge supports enhances the firmness by locating firmness enhancing materials or devices between the upper and lower border wires of the bedding or seating product.

This limits the effectiveness of the edge support and subjects the border wires to excessive bending forces It has therefore been an objective of this invention to provide edge support for a bedding or seating product which extends above the upper border wire and below the bottom border wire so as to enhance the firmness of the edge of the product while preventing the border wire from being repeatedly flexed and possibly permanently bent due to a user sitting on the edge of the bedding or seating product.

Still another objective of this invention has been to provide a solution to the problem of enhancing the edge support of a bedding or seating product in a manner which is as effective or more so than the prior edge supports but which is economical to produce and assemble into a finished product.

SUMMARY OF THE INVENTION

The bedding or seating product of the present invention which accomplishes these objectives comprises a spring core comprising a plurality of connected, aligned coil springs having coplanar upper end turns in a first plane and coplanar lower end turns in a second plane. Edge support means are located around the perimeter of the spring core and extend above the first plane and below the second plane. Filling material is located inside the edge support means both above the first plane and below the second plane. The filling material, spring core and edge support means are all enclosed in an upholstered covering.

The edge support means may be a string of pocketed springs, each of the springs having a height greater than the height of the springs of the centrally located spring core. The springs may be individually pocketed or unpocketed.

Alternatively, the edge support means may be a pair of spiral edge supports located around the perimeter of the spring core, each spiral edge support comprising a helical spring coil enclosed in fabric. The spiral edge supports may or may not be secured to a pair of border wires surrounding the spring core. One of the spiral edge supports is located above the outermost rows and columns of the spring core and the other spiral edge support is located below the outermost rows and columns of the spring core.

As yet a third alternative, the edge support may comprise a pair of plastic edge reinforcements located around the perimeter of the spring core which snap fit or releasably secure to border wires of the bedding or seating product. The plastic edge reinforcements are located generally above and below the outermost rows and outermost columns of the spring core.

In each of these embodiments the edge support means extends above the first plane defined by the upper end turns of the spring core and extends below the second plane defined by the lower end turns of the springs of the spring core. In each embodiment filling material is located inside the edge support means above and below the spring core in order to fill the centrally located void created by the edge support means. The spring core, edge support means and layers of filling material are encased in an upholstered covering. Thus, a bedding or seating product is provided having edge support means which extends above and below a centrally located spring core. The edge support means functions to economically strengthen the periphery of the bedding or seating product and prevent sagging of the spring core along the edge portions of the bedding or seating product.

These objectives and advantages of the present invention will become more readily apparent from the following description of the drawings in which:

DETAILED DESCRIPTION OF THE DRAWINGS

Figure 1:
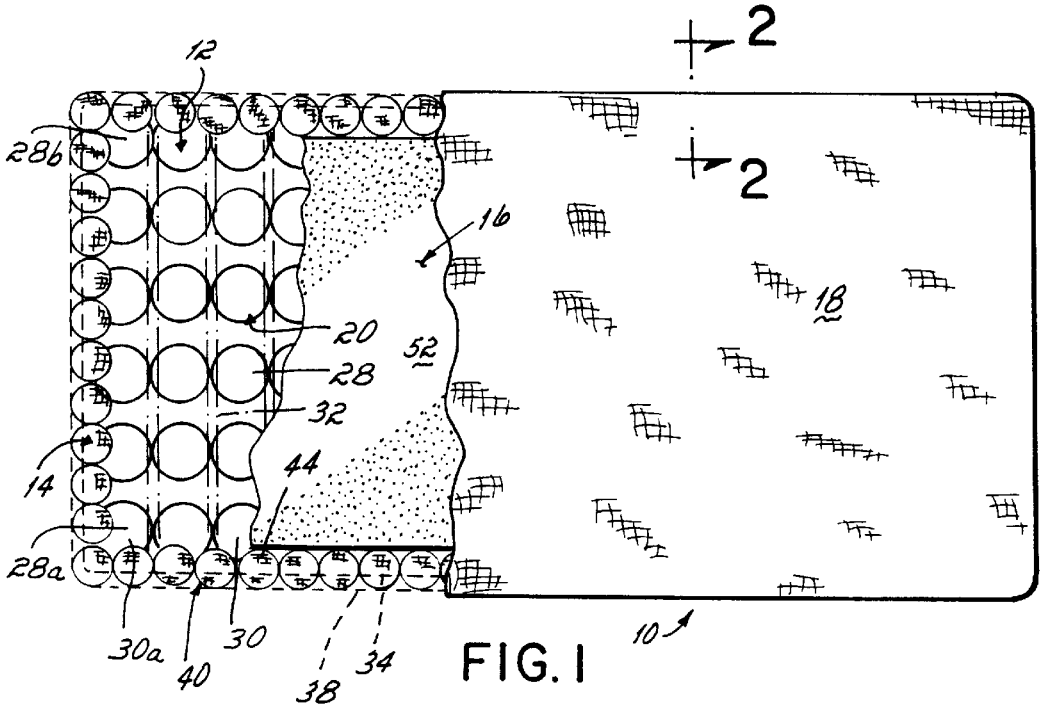
FIG. 1 is a top plan view of a first embodiment of the of the present invention utilizing individually pocketed springs located around the perimeter of a central spring core as an edge support.

Referring the drawings, and particularly to FIG. 1, there is illustrated a bedding or seating product 10. The bedding or seating product 10 may have a generally rectangular shape like a mattress or may be square or any other shape. The bedding or seating product comprises a centrally located spring core 12, edge support means noted generally at 14, filling material 16 and an upholstered covering 18 encasing the spring core 12, the edge support means 14 and the filling material 16. The upholstered covering may be tufted, quilted or a thin layer of fabric.

Figure 2:
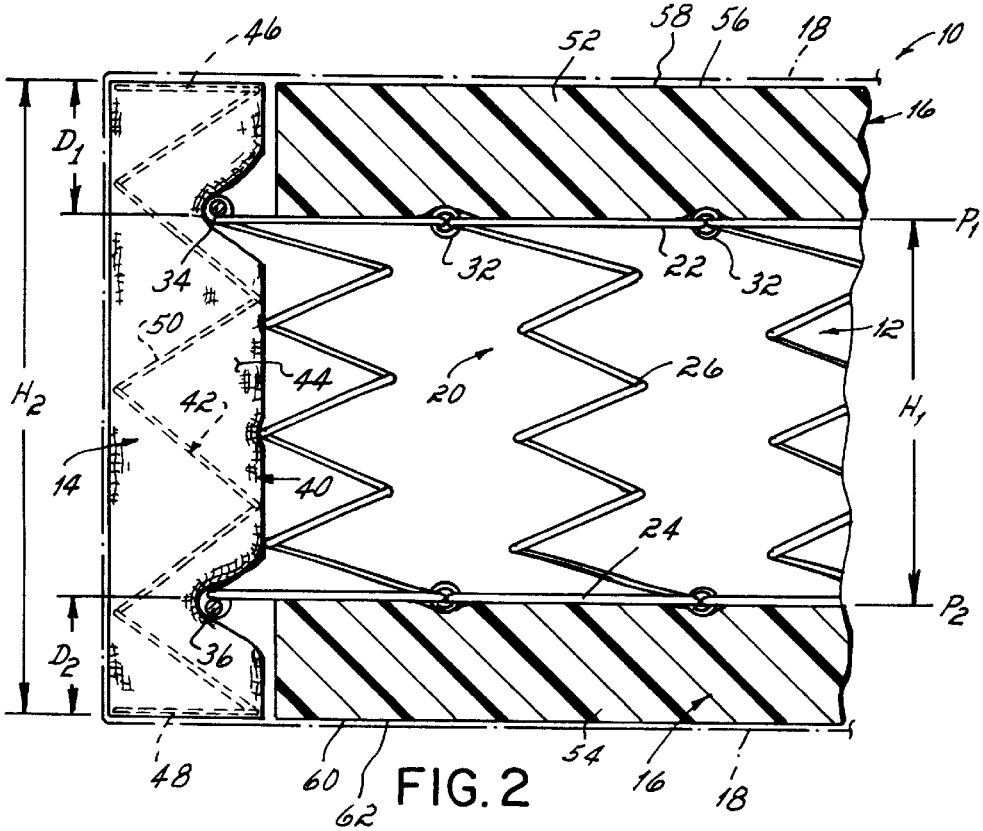
FIG. 2 is a view taken along line 2—2 of FIG. 1.

The spring core 12 is illustrated as being a conventional spring core made up of a plurality of aligned interconnected coil springs 20, each having an upper end turn 22, a lower end turn 24 and a plurality of centrally located revolutions or convolutions 26 extending between the upper and lower end turns (see FIG. 2). Because the bedding product 10 illustrated in FIG. 1 has a generally rectangular configuration, it has a longitudinal dimension and a transverse dimension, the longitudinal dimension being greater than the transverse dimension. The coil springs 20 are arranged in longitudinally extending columns 28 and transversely extending rows 30. Adjacent rows 30 of coil springs are connected to each other with transversely extending helical lacing wires 32, which connect adjacent upper end turns of adjacent rows of coil springs and adjacent lower end turns of adjacent rows of coil springs. This is best illustrated in FIG. 2. Although helical lacing wires are illustrated as being used to connect adjacent rows of coil springs, hog rings or any other type of fastener may be used as well. Alternatively, the springs may be encased in fabric pockets and the fabric pockets attached, all as is conventional in the art.

The spring core 12 has a pair of outermost rows (only row 30*a* being shown) and a pair of opposed outermost columns 28*a*, 28*b* of springs. Due to the upholstered covering 18 illustrated in FIG. 1, only outermost row 30*a* and only a portion of the outermost columns 28*a*, 28*b* are illustrated. A generally rectangular upper border wire 34 located generally in plane $P_1$ surrounds the spring core 12 and is secured to the outermost rows and columns of coil springs. Similarly, a lower border wire 36 located generally in plane $P_2$ is secured to the outermost columns and rows of coil springs. Although these border wires are illustrated in FIGS. 1 and 2 as being rectangular, they may be any configuration depending upon the configuration of the spring core 12.

As best illustrated in FIG. 2 the coil springs of the spring core have coplanar upper end turns 22 in a first plane $P_1$ and coplanar lower end turns 24 in a second plane $P_2$. Thus, the springs of the spring core are all of a first height $H_1$ extending between the first and second planes $P_1$ and $P_2$. Although coil springs are illustrated and described in this application, any type of spring or even resilient foam may be used in the core without departing from the spirit of the invention of this application.

In one embodiment of the invention of this application illustrated in FIGS. 1 and 2, the edge support means 14 comprises a string 38 of individually pocketed coil springs 40. These individually pocketed coil springs 40 are connected to each other and arranged in a string 38 which surrounds the spring core 12. As is evident from FIG. 1, the string 38 is located completely around the periphery of the bedding or seating product 10. Each of these individually pocketed springs 40 is of a second height $H_2$ (see FIG. 2) greater than the height $H_1$ of the spring core. Each pocketed coil 40 of the string 38 of springs extends above the plane $P_1$ defined by the upper ends turns 22 of the springs 20 of the spring core 12 a distance $D_1$ and also extends below the plane $P_2$ defined by the lower end turns 24 of the springs 20 of the spring core 12 a distance $D_2$ (see FIG. 2). Each of the pocketed coils 40 comprises an individual or edge coil spring 42 encased in a pocket of woven or unwoven fabric material 44. The individual or edge coil spring 42 within each pocket of fabric 44 has an upper end turn 46, a lower end turn 48 and a plurality of central convolutions 50. The central convolutions 50 may abut against the central convolutions 26 of the springs 20 of the outermost rows and columns of the spring core 12. The distance between the upper end turns 46 and the lower end turns 48 defines the second height $H_2$ of the pocketed coils 40. As best illustrated in FIG. 1 the pocketed coils 40 are located between the outermost coil springs along the outermost rows and columns of the spring core and may be secured to the upper and lower border wires 34, 36 with hog rings or any other fasteners. Although each edge spring 42 is illustrated as being encased in a fabric pocket 44, the edge springs 42 may be unpocketed as well.

The string 38 of pocketed coils 40 prevents the sagging of the edge of a bedding or seating product over time due to excessive wear. The fact that the individually pocketed coils are of a height $H_2$ significantly greater than the height $H_1$ of the spring core 12 enables an upper layer of filling material 52 to be inserted on top of the spring core 12 and a bottom layer of filling material 54 located below the spring core 12. Both the upper and lower layers of filling material 52, 54 are located inside the string of pocketed coils 40 and provide a uniform upper surface 56 generally in a top plane 58 and a uniform lower surface 60 generally in a bottom plane 62. Once the layers of filling material 52, 54 are inserted inside the string 38 of pocketed coils 40, the upholstered covering 18 may be wrapped around the spring core 12, the upper and lower layers of filling material 52, 54 and the string of pocketed coils. The filling material may be polyurethane foam, cotton or polyester fibers or any other type of soft and resilient filling material. Although each layer of filling material 52, 54 is illustrated as being a single piece or ply of material, it may alternatively comprises multiple layers of material.

Figure 3:
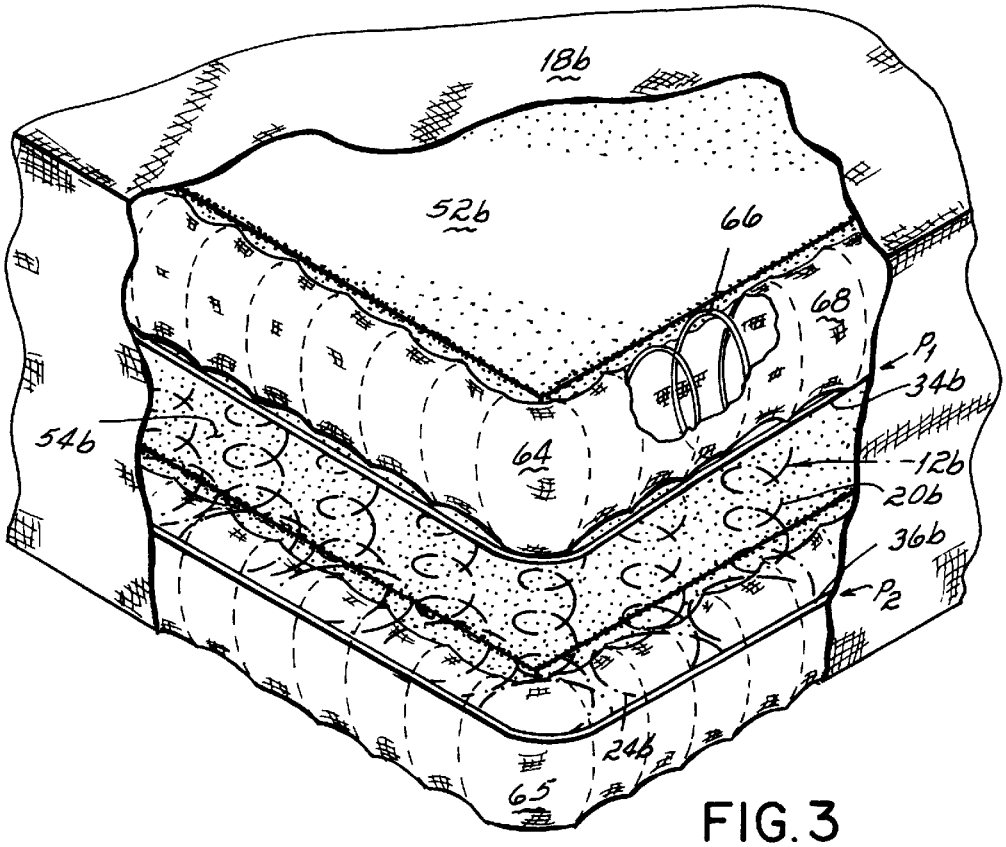
FIG. 3 is a fragmentary perspective view of the second embodiment of the present invention in which a pair of spiral edge supports are used in order to strengthen the periphery of a bedding or seating product.

Referring now to FIG. 3 a second embodiment of edge support is illustrated. This embodiment of edge support comprises a pair of spiral edge supports 64 and 65 located around the perimeter of a spring core 12*b*. The spring core 12*b* may be any type of spring core but for the sake of simplicity, we will assume it is identical to the spring core 12 illustrated in FIGS. 1 and 2 with like numbers representing like parts. Different letters b and c will designate the different embodiments. Each of the spiral edge supports 64, 65 comprises a helical spring coil 66 encased in fabric 68. Spiral edge support 64 is located around the perimeter of the spring core 12*b* and generally above the plane $P_1$ defined by the upper border wire 34*b* and the upper end turns 22*b* of each of the coil springs 20*b* making up the spring core 12*b*. The spiral edge support 64 is located generally above the outermost rows and columns of the spring core around the perimeter of the bedding or seating product. Likewise, the other spiral edge support 65 is located below the outermost rows and columns of the spring core. The spiral edge supports 64, 65 may or may not be secured to either the upper or lower border wires of the spring core or to the upper or lower end turns of the outermost springs of the spring core.

As with the first embodiment illustrated in FIGS. 1 and 2, in this embodiment, an upper layer of filling material 52*b* is located inside the spiral edge support 64 and a bottom layer of filling material 54*b* is located inside the spiral edge support 65 below the spring core. The filling layers, the spring core and the pair of spiral edge supports are all encased in a fabric covering 18*b* as best illustrated in FIG. 3. Like the string of individually pocketed coils of the first embodiment, the purpose of the pair of spiral edge supports is to enhance the firmness along the periphery of the bedding or seating product and to prevent its sagging due to repetitive use.

Figure 4:
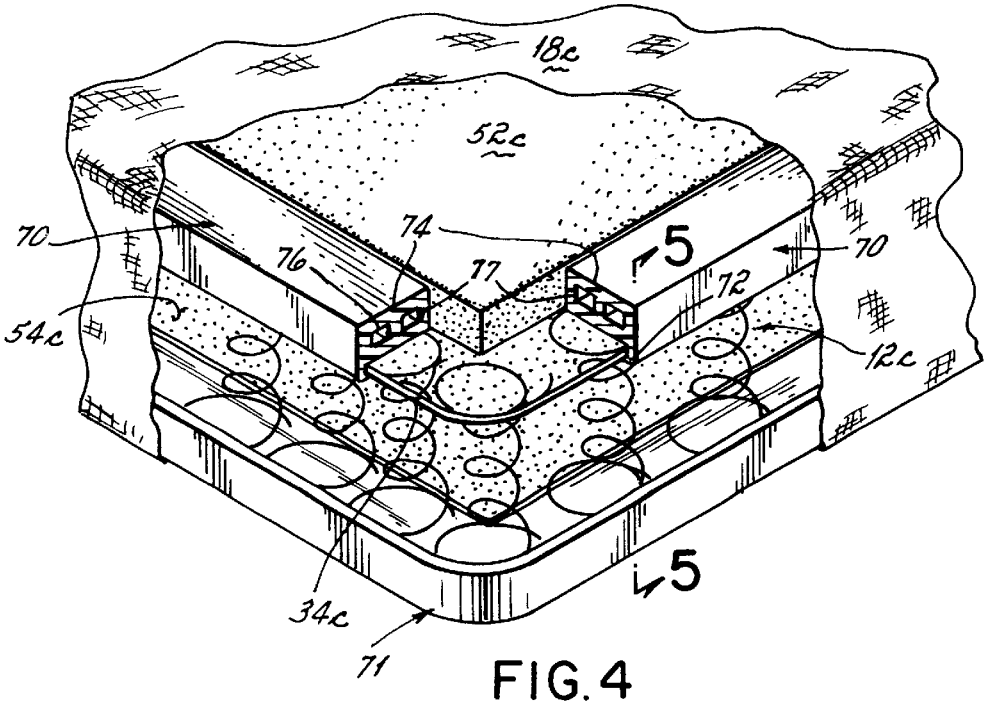
FIG. 4 is a fragmentary perspective view of a third embodiment of the present invention in which a pair of plastic edge reinforcements are used to strengthen the peripheral portions of the bedding or seating product.
Figure 5:
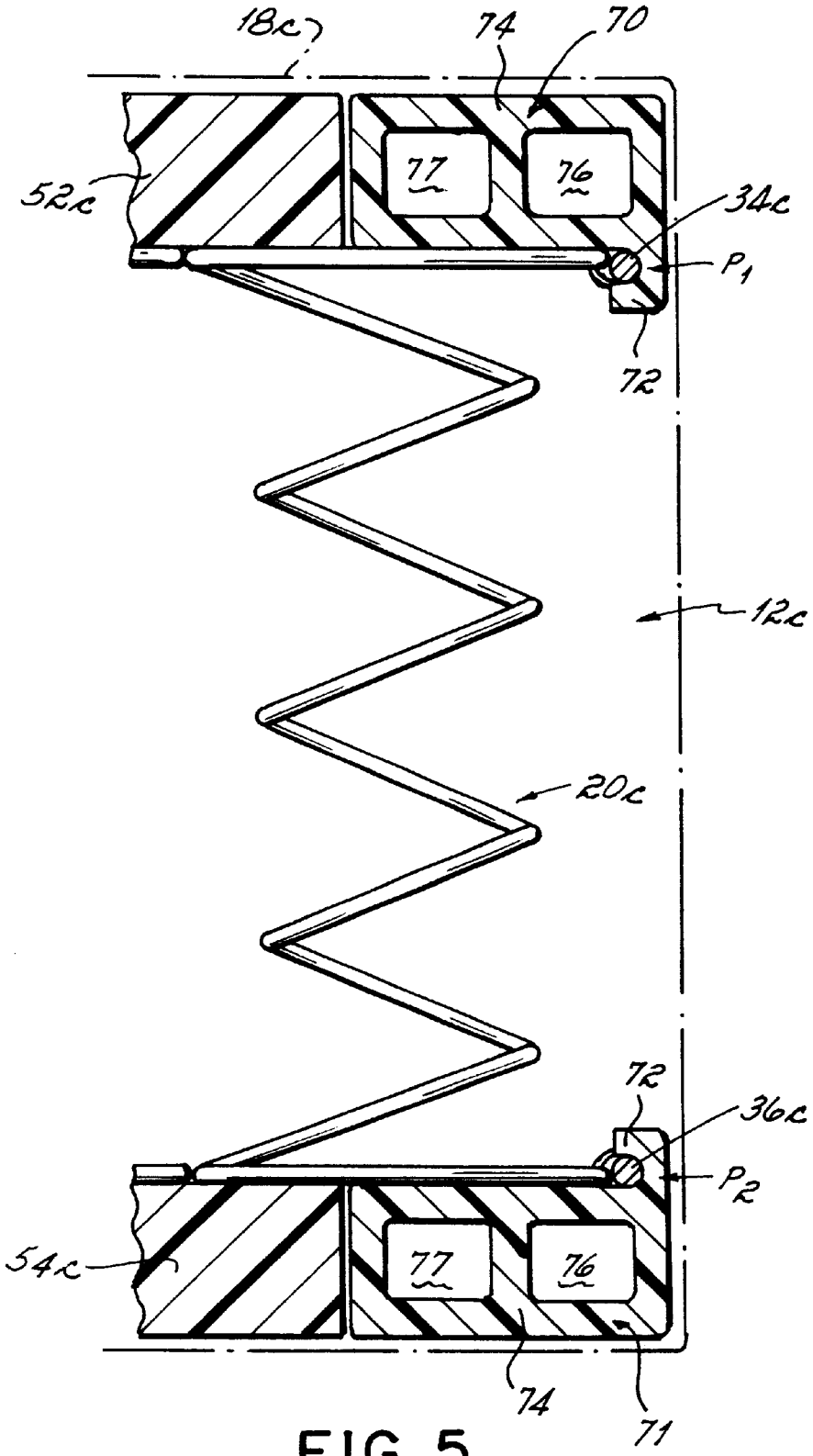
FIG. 5 is a view taken along the line 5—5 of FIG. 4.

A third embodiment of edge support for use with a spring core is illustrated in FIG. 4. This embodiment of edge support comprises a pair of plastic edge reinforcements 70 and 71. Each of these plastic edge reinforcements extends around the periphery of the bedding or seating product and is releasably secured or snap fit secured to the upper and lower border wires 34*c*, 36*c* of the spring core 12*c* (see FIG. 5). An upper edge reinforcement 70 is located generally above the first plane $P_1$ of the spring core, whereas the other plastic edge reinforcement 71 extends generally below the second plane $P_2$. As best illustrated in FIG. 5, each plastic edge reinforcement has a lip portion 72, and a central portion 74, the central portion 74 may have recesses 76, 77 formed therein to create a hollow type of profile of the plastic edge reinforcements. Alternatively, although not illustrated, the central portion of the plastic edge reinforcement may be solid without the recesses. The plastic edge reinforcements are typically made of extruded closed cell polyethylene but may be made of any plastic material.

Again, as in the other two embodiments, filling layers 52*c* and 54*c* are located inside the edge support means in order to create a uniform top surface and a uniform bottom surface. As illustrated in FIG. 4 an upholstered covering 18*c* is wrapped around the filling layers 52*c*, 54*c*, the spring core 12 and the plastic edge reinforcements.

As will be obvious to those of ordinary skill in the art, the present invention is not limited to use with inner spring cores comprising aligned coil springs interconnected with helical lacing wires. Any type of bedding or cushion core may be utilized in accordance with any of the embodiments of edge support described hereinabove in this application.

Having described three embodiments of edge supports, other variations and changes will be apparent to those of ordinary skill in the art. Therefore we do not intend to be limited except by the scope of the following claims.

What is claimed is:

1. A bedding or seating product comprising:

a central spring core comprising a plurality of connected, aligned springs of a first height, a plurality of springs of a second height, said second height being greater than said first height, said springs of a second height being arranged around the perimeter of said central spring core such that said springs of a second height protrude above and below the central spring core and function as an edge support wherein said springs of a second height are secured to border wires secured to select springs of said central spring core.

2. The bedding or seating product of claim 1 wherein said springs of a second height are individually pocketed.

3. The bedding or seating product of claim 1 further comprising a pair of filling layers, one of said filling layers being located above said central spring core and one of said filling layers being located below said central spring core.

4. A method of reinforcing the edge of a bedding or seating product comprising:

providing a central spring core comprising a plurality of connected, aligned springs of a first height, placing a plurality of springs of a second height around the perimeter of said spring core, said second height being greater than said first height, such that said springs of a second height function as an edge support, securing said springs of a second height to at least one border wire of said central spring core.

5. The method of claim 4 further comprising placing filling material above and below said central spring core and encapsulating said springs and filling material in a fabric covering.

6. The method of claim 4 further comprising encapsulating each of said springs of a second height in a fabric pocket.

7. A method of reinforcing the edge of a bedding or seating product comprising:

providing a spring core of a plurality of springs, said springs having coplanar end turns in a first plane and coplanar end turns in a second plane, inserting a string of edge springs around the perimeter of said spring core such that each of said edge springs extends above the first plane and below the second plane, placing filling material inside said string of edge springs above and below said spring core, and encapsulating said spring core, filling material and string of edge springs in a fabric covering.

8. A method of reinforcing the edge of a bedding or seating product comprising:

providing a spring core of a plurality of springs, said springs having coplanar end turns in a first plane and coplanar end turns in a second plane, inserting a string of individually pocketed springs around the perimeter of said spring core such that each of said individually pocketed springs extends above the first plane and below the second plane, placing filling material inside said string of individually pocketed springs above and below said spring core, and encapsulating said spring core, filling material and string of individually pocketed springs in a fabric covering.

* * * * *